US005298003A

United States Patent [19]

Weihe et al.

[11] Patent Number: 5,298,003

[45] Date of Patent: Mar. 29, 1994

[54] APPARATUS FOR CREATING A SWIM-IN-PLACE CURRENT IN A SWIMMING POOL

[76] Inventors: Clyde R. Weihe, 17 Lindbergh Ave., Needham Heights, Mass. 02194; Thomas H. Larsen, 44 Robin Rd., Weston, Mass. 02193

[21] Appl. No.: 940,036

[22] Filed: Sep. 3, 1992

Related U.S. Application Data

[63] Continuation-in-part of Ser. No. 898,472, Jun. 15, 1992, abandoned.

[51] Int. Cl.[5] ..... A63B 1/00

[52] U.S. Cl. ..... 482/55; 4/492

[58] Field of Search ..... 482/55, 56, 111; 434/254; 4/488, 491, 492, 496; 405/76, 79, 80

[56] References Cited

U.S. PATENT DOCUMENTS

| | | | |
|---|---|---|---|
| 3,534,413 | 10/1970 | Plasseraud | 482/55 X |
| 4,561,133 | 12/1985 | Laing | 4/491 |
| 4,665,572 | 5/1987 | Davidson et al. | 4/492 |
| 4,934,689 | 6/1990 | Burdenko | 482/55 X |

*Primary Examiner*—Richard J. Apley
*Assistant Examiner*—Glenn E. Richman
*Attorney, Agent, or Firm*—Wolf, Greenfield & Sacks

[57] ABSTRACT

Apparatus for creating a current in a swimming pool against which a swimmer can swim-in-place in the pool, the pool comprising a water basin having an upper rim and being filled with water up to a predetermined upper level below the rim, the apparatus comprising a propeller and a motor mechanism for driving the propeller; a mechanism connected to the propeller for positioning the propeller at selected depth below the upper level of water in the basin such that when the propeller is driven the propeller generates a current of water flowing in a selected direction between about 0.1 and about 4 feet below the upper level of water in the basin; a mechanism for immovably mounting the positioning mechanism at a selected position around the rim of the basin, the positioning mechanism being connected to the mounting mechanism; the mechanism for mounting being portable such that the propeller and positioning mechanism are transportable to and away from the rim of the basin; the mounting mechanism being immovably mountable at the selected position around the rim of the pool; a rigid protective housing mounted around the propeller such that the propeller is completely surrounded by the housing, the protective housing being impenetrable by a human body part and being permeable to the current of the water flow generated by the propeller when driven.

20 Claims, 4 Drawing Sheets

APPARATUS FOR CREATING A SWIM-IN-PLACE CURRENT IN A SWIMMING POOL

CROSS-REFERENCE TO RELATED APPLICATIONS

This is a continuation in-part of U.S. application Ser. No. 07/898,472 for A PORTABLE SWIM-IN PLACE MACHINE filed Jun. 15, 1992, now abandoned.

BACKGROUND OF THE INVENTION

The present invention relates to an apparatus for generating a current in swimming pool against which a swimmer can swim in a generally stationary place without having to swim the entire length of the pool. More particularly, the present invention relates to a safe, simple and portable apparatus having motor driven components which can be driven with low voltage electrical power.

SUMMARY OF THE INVENTION

Swimming pools installed in or on the grounds of private property owners are generally too small in size for purposes of enabling a user to perform long distance lap swimming. Larger sized pools suitable for long distance lap swimming are expensive to build and maintain and there is therefore a need to convert smaller, inexpensive pools into usage for long distance swimming. Prior apparati such as disclosed in U.S. Pat, No. 5,005,228 have been proposed which generate a continuous end to end current in small sized tank against which a swimmer can swim in one relatively stationary place. Such apparati are, however, difficult and expensive to manufacture and comprise a current generating apparatus integral with the swimming pool.

The present invention provides a portable current generating apparatus which can be removably mounted on and dismounted from any existing pool structure and can generate a swim in place current with a low voltage and low power source of power supply.

In accordance with the invention therefore, there is provided an apparatus for creating a current in a swimming pool against which a swimmer can swim in place in the pool, the pool comprising a water basin having an upper rim and being filled with water up to a predetermined upper level below the rim, the apparatus comprising a propeller and a motor mechanism for driving the propeller; a mechanism connected to the propeller for immovably positioning the propeller at selected depth below the upper level of water in the basin such that when the propeller is driven the propeller generates a current of water flowing in a selected direction between about 0.1 and about 4 feet below the upper level of water in the basin; the mechanism for positioning being connected to a mechanism for mounting the positioning mechanism at a selected position around the rim of the basin; the mounting mechanism being portable such that the propeller and positioning mechanism are transportable to and away from the selected position around the rim of the basin; the mounting mechanism being immovably mountable at the selected position around the rim of the pool; a rigid protective housing being mounted around the propeller such that the propeller is completely surrounded by the housing, the housing being impenetrable by a human body part and being permeable to the current of the water flow generated by the propeller when driven.

DETAILED DESCRIPTION OF EXEMPLARY EMBODIMENTS

Following is a description of exemplary embodiments of the present invention with detailed reference to the accompanying Figures.

Figure 1:
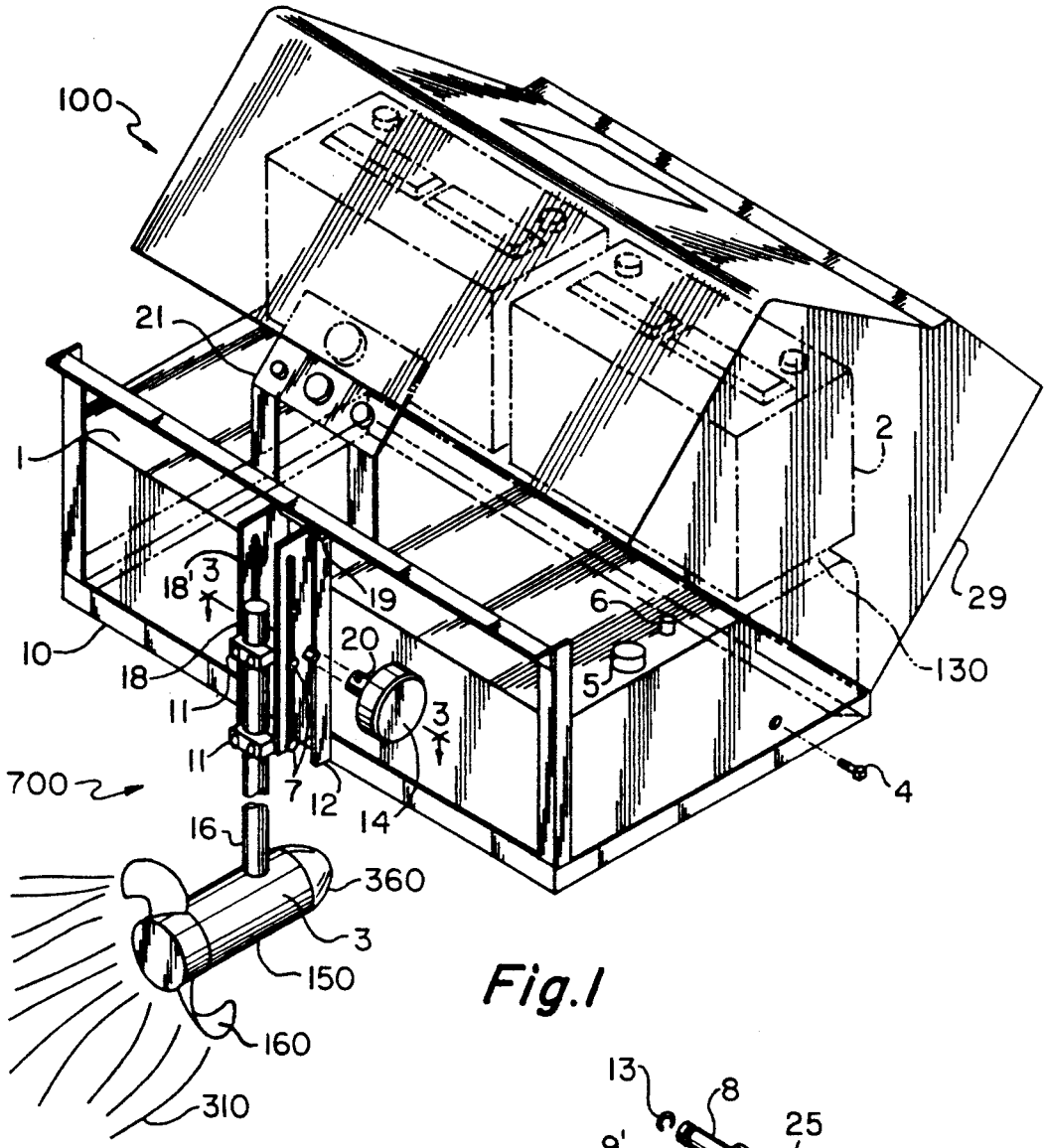
FIG. 1 is a perspective view of a portable swum in place apparatus according to the invention.
Figure 2:
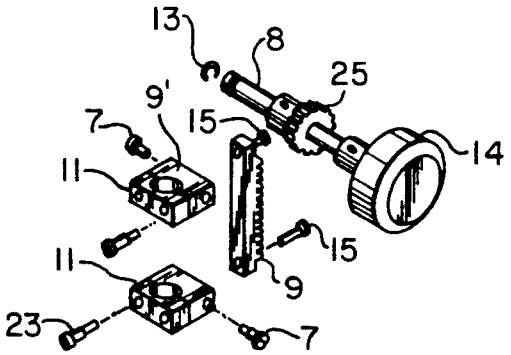
FIG. 2 is an exploded view of a propeller depth adjustment mechanism for use in conjunction with the FIG. 1 apparatus.
Figure 2A:
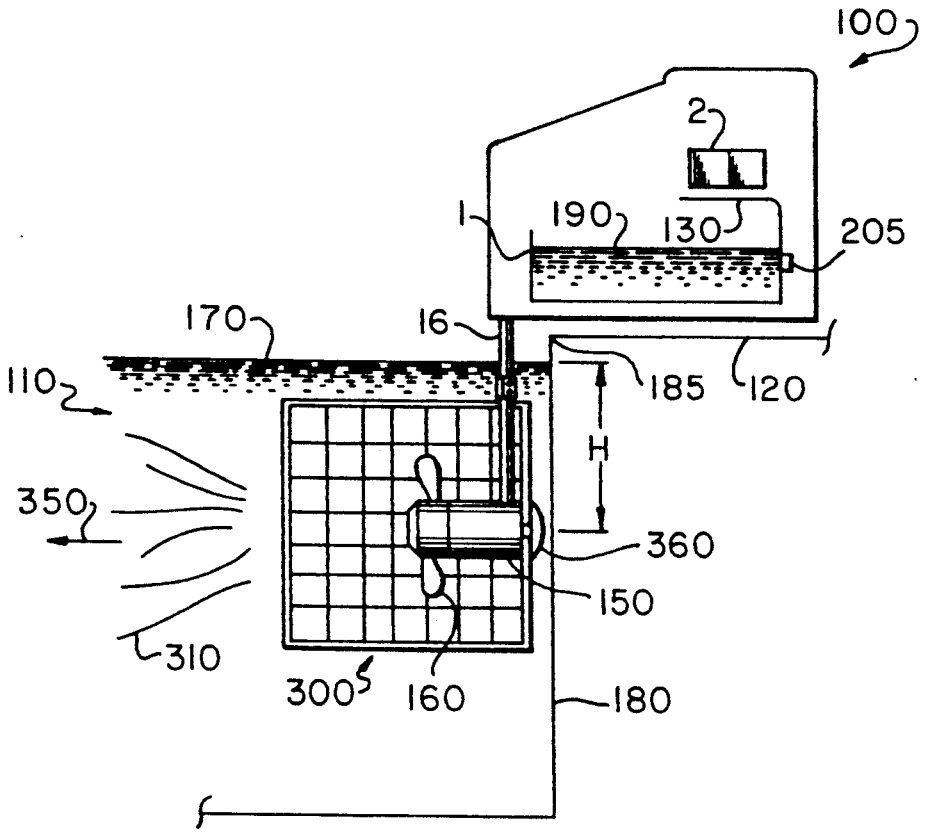
FIG. 2A is a side cross-sectional view of the FIG. 1 apparatus mounted in an appropriate position around the rim of a swimming pool for usage in generating a swim in place current in the pool.

There is shown in FIG. 1 a portable current generating apparatus 200 which can be mounted for use in conjunction with a swimming pool 110, FIG. 2A, of essentially any size or shape. The 200 apparatus comprises a portable housing 100 which includes a relatively light weight shroud or housing 29 typically comprised of molded fiberglass which mounts onto a base or frame 10. The shroud 29 is readily removable from and mountable onto the base 10. Also mounted on the base 10 is a ballast tank 1 for holding water or other heavy weight objects.

Figure 1A:
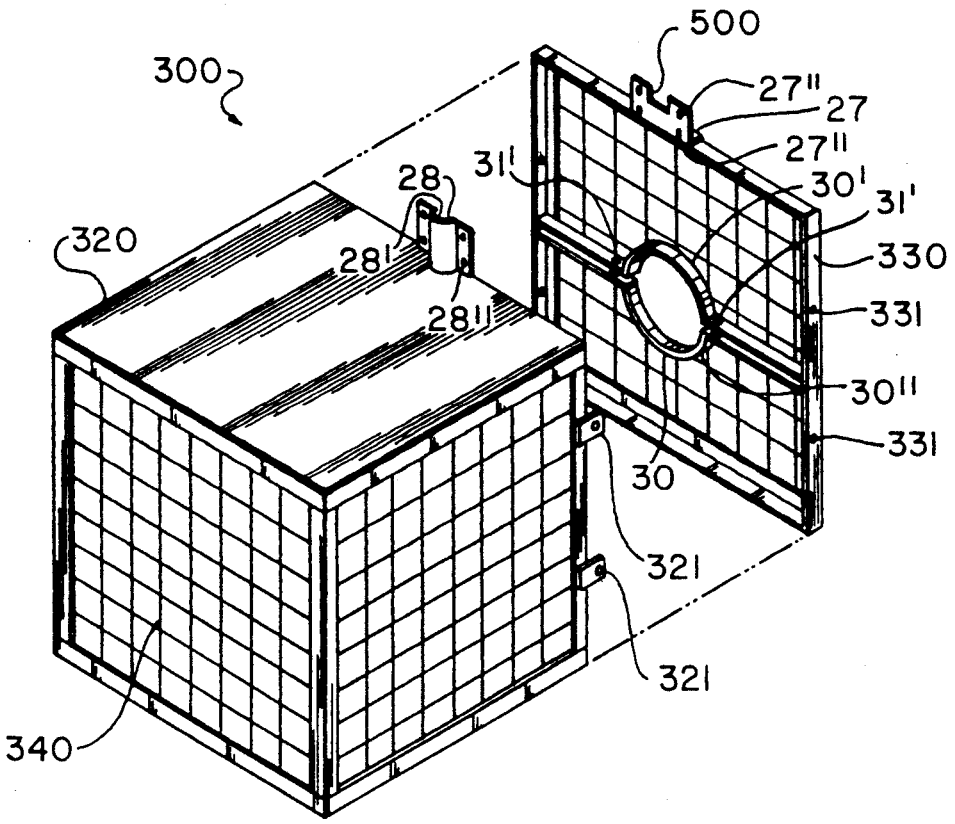
FIG. 1A is an exploded perspective view of a protective housing for a propeller component of the FIG. 1 apparatus.
Figure 1B:
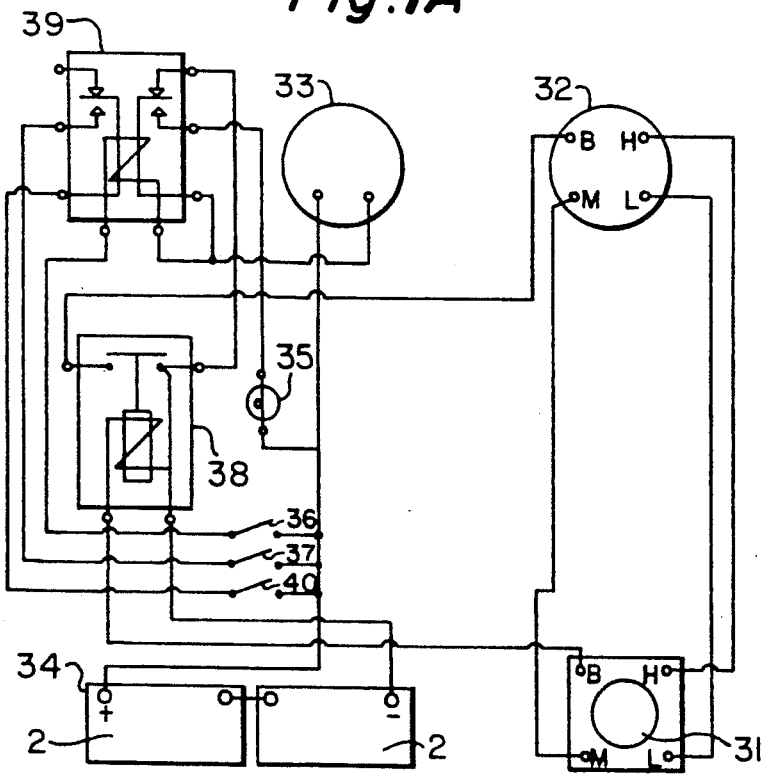
FIG. 1B is an exemplary circuit diagram showing various components which may be used in an electrical circuit for powering a motor which drives the propeller component of FIG. 1.

The ballast tank 1 includes a shelf portion 130 on which batteries 2 are mounted for supplying power to a motor 31, FIG. 1B, which drives a propeller 160. When the shroud 29 is mounted on the base 10, the tank 1 and batteries 2 are enclosed by the shroud 29.

Figure 3:
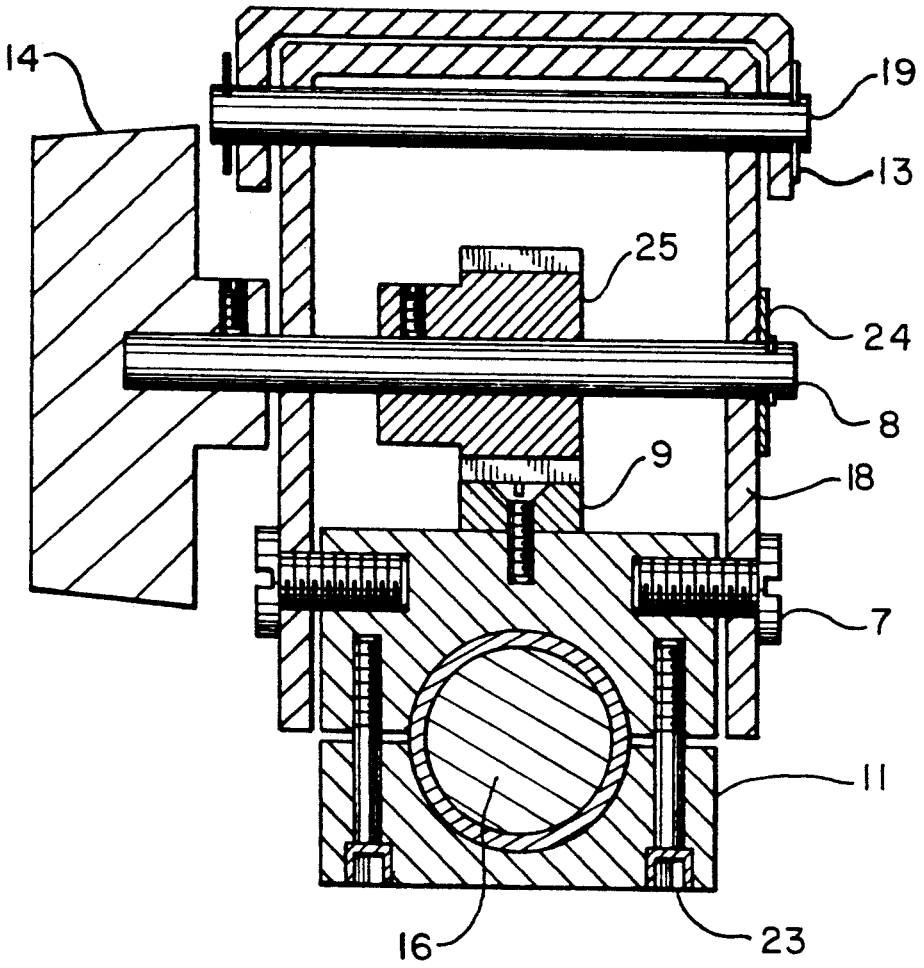
FIG. 3 is a cross sectional view along lines B—B in FIG. 1.

Attached to the front of the portable housing 100 is a propeller depth adjustment mechanism comprising a channel 18, a conventional rack 9 and gear 25 assembly, FIGS. 2, 3 mounted on the channel 18 and a rod or tube 16 connected to the rack 9 by clamp mechanism 9'; 11 and screws 23. The rod 16 is adjustable upwardly and downwardly by turning handle 14 which is connected to gear 25 which is, in turn, engaged with rack 9. Rack 9 is mounted on channels 18 for slidable upward and downward movement within channels 18 via screws 7 which are screwably engaged with a body mount 9' which clamps together with clamp 11 to hold tube 16. Screws 7 are slidably mounted within slots 18' provided in channels 18 for slidably adjustable (under the control of rack 9 and gear 25) upward and downward movement of tube 16 and its attached components 150, 160.

As shown in the embodiment of FIGS. 1, 2A a combined motor and propeller mechanism 3 is attached to the end of upwardly and downwardly adjustable tube or rod 16. In such an embodiment a working motor is water sealably contained within a sealed housing 150 and drivably connected to a rotatable propeller 160. The motor 31 is connected by conventional wiring and electrical circuitry, for example as shown in FIG. 1B, to the batteries 2 for driving the motor. The power output of the batteries 2 is typically connected to the motor 31 via a conventional electrical energy control mechanism such as a potentiometer 32 which allows the user to selectively control the speed of the motor 31. As shown in FIG. 1B the circuitry includes a voltmeter 33, warning light 35, relays 38, 39 and power on/off switch 40.

As can be readily imagined, the propeller 160 can be driven in a variety of conventional ways, for example by a fuel powered motor which can be driven at selectively variable speeds by conventional mechanisms such as a transmission. As shown in FIGS. 1, 2A the motor 31 is mounted within a self contained, water sealed housing 150 on the front end of which is also rotatably mounted the propeller 160. Alternatively, the motor can be mounted within housing 100 or otherwise remote from the propeller 160 and drivably connected by conventional means such as beveled gears and associated drive shafts to propeller 160. Such an embodiment may be preferred where the water 170, FIG. 2A, in the pool 110 into which the propeller 160 is to be disposed contains so much antimicrobial material such as chlorine that a conventional water sealed housing 150 cannot withstand corrosive reaction with the antibacterial material which may be dissolved in the water 170.

In any event, the propeller 160 is mounted on the portable housing 100 for selectively adjustable upward and downward movement relative to the housing 100. In typical use, the portable housing 100 is placed on a selected surface 120 somewhere around the rim 185 of the water basin 180 of the pool 110, as shown in FIG. 2A. The tank 1 is then filled with enough water 190 to weigh the housing 100 down on the surface 120 such that the housing is 100 immovable under the weight of water 190 even when the propeller 160 is driven at the maximum power of the power supply 2. A water level detector 205 may be provided for ensuring that a minimum volume of water sufficient to immovably weight the apparatus 200 down on surface 120 is in the tank 1. For example, a detector 205 may be disposed at a selected level above the bottom of tank 1 which requires a minimum volume of water sufficient to render the housing 100 immovable when the propeller is driven at maximum speed to reside in tank 1 to reach up to the selected level. The detector 205 is connected to the circuitry or the batteries 2 such that when the water 190 in tank 1 falls below the level at which detector 205 is disposed, the power supply to the motor is automatically interrupted.

When the housing 100 is transported to a selected position around the rim 185 of the basin 180, it is positioned on a surface 120 at the edge of the rim 185 such that the tube or rod 16 connected to the housing 100 extends radially inwardly toward the center of basin 180 just beyond rim 185. The pool 110 is filled with water 170 up to a selected top level. Once the housing 100 is so positioned, it may be weighted down by filling tank 1 with the minimum amount of water 190 and rod or tube 16 may be adjusted upwardly or downwardly such that propeller 160 is positioned at any selected depth H beneath the top level of water 170 by operation of handle 14, FIGS. 1-3. Typically the propeller is positioned between about 0.1 and about 4 feet below the top surface level of water 170 in the basin 180, most preferably between about 0.1 and about 2.5 feet. As can be readily imagined, tube 16 by virtue of its connection to rack 9 can be selectively positioned upwardly or downwardly by turning of handle 14 which, in turn, turns gear 25 which, in turn, causes slidable upward or downward movement of rack 9.

The housing 100 can be alternatively weighted down so as to be immovable against the force caused by the driven propeller 160 by other conventional weighting down means other than water 190. For example, heavy space compact objects such as bricks which may be readily placed within housing 100 (and readily removed when housing 100 is to be transported to another location) may be used.

The propeller 160 is preferably completely surrounded by a housing 300, FIGS. 1A, 2A, which is permeable at least to the current 310 of water which is generated by propeller 160 when driven. The housing 300 is mountable around and dismountable from around the propeller 160 to enable repair or replacement of the propeller 160 and/or its associated motor which may reside within housing 150. As shown in FIG. 1A, the protective housing 300 comprises a cage which includes two cage housing sections 320, 330 readily attachable to and detachable from each other by conventional means such as bolts or pins (not shown) fastenable between complementary apertures 321, 331 provided on the body or a frame portion of housing sections 320 and 330, FIG. 1A.

A clamp mechanism 27, 28 is provided on housing 300 for rigidly securing the housing 300 in a stationary position relative to propeller 160. As shown in FIG. 1A, the clamp mechanism comprises first 27 and second 28 complementary clamp sections attached to the body or a frame portion of protective housing sections 330, 320 respectively. Clamp section 28 includes a recess or sleeve 28' for receiving tube or rod 16. When the tube or rod is disposed within the recess 28' the two clamp sections 27, 28 are brought together and clamped by conventional means such as bolts (not shown) extending between complementary apertures 27" and 28", FIG. 1A. When the two clamp sections 27, 28 are clamped together the tube or rod 16 is rigidly clamped between the clamp sections 27, 28 such that the tube or rod 16 and the propeller 160 connected to the tube or rod 16 are rigidly stationary relative to the clamped together housing 300.

The housing section 330 may be provided in the embodiment shown with a second clamp 30 comprising top 30' and bottom 30" clamping sections clampable together via conventional means such as bolts 31' which extend between complementary apertures provided in integral extension portions of the upper 30' and lower 30" clamp sections. The rear end of the housing 150, FIGS. 1, 2A is insertable between clamping sections 30', 30" which when clamped together compressibly engage the rear end of housing 150 so as to more stably secure propeller 160 in a stationary position relative to protective housing 300 when clamped together.

In an embodiment where the motor is mounted in the apparatus 200 outside of the clamped together protective housing 300, the housing 300 is, in any event, rigidly secured to whatever support structure on which the propeller 160 is rotatably mounted such that the protective housing completely surrounds the propeller 160 and remains stationary relative to the propeller 160 even when the propeller is driven at maximum speed.

An automatic power supply interrupt mechanism 500 is preferably connected to one or more of the clamp mechanisms which attach the housing sections 330, 320 together, FIG. 1A. The automatic power supply interrupt mechanism 500 interacts between the complementary components of a clamp mechanism 27, 28 or 321, 331 in a conventional way such that, if and when one of clamps become detached, the power supply to the motor is automatically interrupted. In one preferred embodiment, the clamp elements 27, 28 comprise a magnetic switch connected to the power supply or circuitry in such a way that when the clamp elements 27, 28 are magnetically or magneto electrically disconnected the clamp-switch 27, 28 is in a off position or mode and the power from the source to the motor is interrupted.

As can be readily imagined, the propeller 160 when driven drives the water 170 in which it is submerged in a generally forward current 310 direction 350. The current 310 is directed in a direction 350 across a horizontal length of the pool 110 which is long enough to accommodate the length of a swimmer, for example, along a generally horizontal length of the pool of at least about 6–20 feet. At least the front end 340 of the protective housing 300 is permeable to water flow such that the front end 340 does not interfere in any substantial way with the current flow 310 emanating from propeller 160. Typically the substantial entirety of the housing 300 is water permeable. As shown in FIGS. 1A, 2A the walls of the housing 300 comprise a rigid wire mesh, the spacing between the wires being close enough such that a human body part cannot penetrate through the mesh to any substantial degree whereby the human body part could possibly touch the propeller 160.

The batteries 2 or other source of electric power supply preferably is of relatively low maximum voltage, e.g. less than about 35 volts and typically less than about 25 volts such that if the power source should accidentally fall into the pool water, swimmers are at no risk of harm of shock.

Figure 2B:
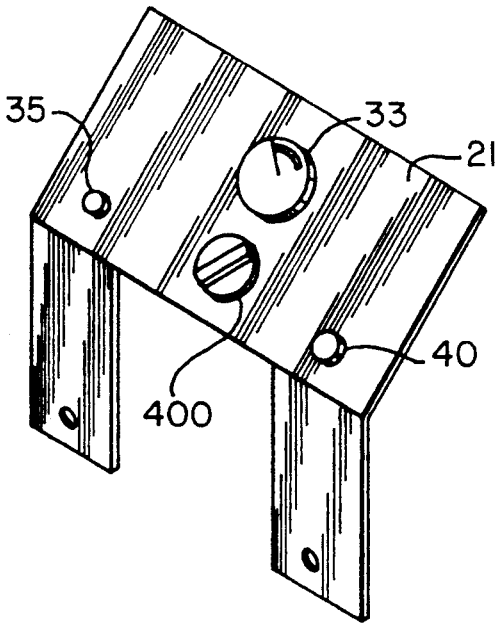
FIG. 2B is a perspective view of a control panel for operating the FIG. 1 apparatus.

A control panel 21, FIG. 1, is typically mounted on the housing 100 for ready access by the user to turn the power to the apparatus 200 on via key switch 40 and to adjust the speed of the propeller 160 via a control 400 for the potentiometer 32, FIGS. 2B, 1B. As shown, the control panel 21 is mounted on the frame of the housing 100 for easy manual access by the user when the shroud 29 is in an enclosing mounted position on the frame.

In another embodiment, the batteries 2 or other power supply source may be located at a location remote from the rim 185 of the pool 110 and connected by conventional wiring to the circuitry of the portable apparatus 200 which is mounted at a position at the rim 185 from the remote location of the batteries 2.

In the embodiment shown in FIGS. 1, 2A, a resiliently compressible shock absorbing material 360 such as rubber is attached to the rearmost end of the structure 150 on which the propeller 160 is rotatably mounted. The shock absorbing material ensures against damage to the wall of basin 180 which might occur when the propeller mounting structure 150 is urged in the opposite direction of direction 350 when propeller 160 is driven. As shown in FIG. 2A, the propeller 160 and mounting structure 150 is typically positioned closely adjacent the wall of the basin 180 when the apparatus 200 is mounted on surface 120 immediately surrounding rim 185 in order to minimize the propeller 160 and housing 300 from occupying space within the water 170 in filled basin 180.

It will now be apparent to those skilled in the art that other embodiments, improvements, details and uses can be made consistent with the letter and spirit of the foregoing disclosure and within the scope of this patent, which is limited only by the following claims, construed in accordance with the patent law including the doctrine of equivalents.

What is claimed is:

1. Apparatus for creating a current in a swimming pool against which a swimmer can swim in place in the pool, the pool comprising a water basin having an upper rim and being filled with water up to a predetermined upper level below the rim, the apparatus comprising:

a propeller and a motor means for driving the propeller; means connected to the propeller for positioning the propeller at selected depth below the upper level of water in the basin such that when the propeller is driven the propeller generates a current of water flowing in a selected direction between about 0.1 and about 4 feet below the upper level of water in the basin;

means for immovably mounting the positioning means at a selected position around the rim of the basin, the positioning means being connected to the mounting means;

the means for mounting being portable such that the propeller and positioning means are transportable to and away from the rim of the basin;

the mounting means being immovably mountable at the selected position around the rim of the pool;

a rigid protective housing mounted around the propeller such that the propeller is completely surrounded by the housing, the housing being impenetrable by a human body part and being permeable to the current of the water flow generated by the propeller when driven; wherein the means for mounting the positioning means comprises a portable housing connected to the positioning means, the portable housing having means for receiving and containing a selected volume of water sufficient to immovably seat the housing by weight force on a surface above and around the rim of the basin at a selected position; and means for detecting the volume of water contained within the housing, the means for detecting including means for automatically stopping the motor means when the volume of water contained within the housing is less than a selected minimum volume.

2. The apparatus of claim 1 wherein the positioning means includes means for selectively adjusting the position of the propeller at a selected depth below the upper level of water in the basin.

3. The apparatus of claim 1 wherein the protective housing includes means for reversibly mounting and dismounting the housing from completely surrounding the propeller, the means for reversibly mounting being connected to a means for automatically stopping the propeller such that when the housing is dismounted from completely surrounding the propeller the propeller is automatically stopped.

4. The apparatus of claim 3 wherein the protective housing comprises a cage mounted around the propeller, the cage comprising first and second housing sections attachable to and detachable from each other by a latch means having attached and detached positions, the latch means being connected to the means for automatically stopping, the means for automatically stopping acting to automatically stop the propeller when the latch means is in the detached position.

5. The apparatus of claim 4 wherein the means for automatically stopping the propeller comprises a switch connected to a source of power for supplying the motor means, the switch interrupting the supply of power to the motor means when the latch means is in the detached position.

6. The apparatus of claim 4 wherein the latch means comprises a switch mechanism connected to a source of power for supplying power to the motor means, the switch mechanism automatically interrupting the supply of power to the motor means when the latch means is in the detached position.

7. The apparatus of claim 1 further comprising a low voltage rechargeable battery means for supplying power to the motor means.

8. The apparatus of claim 7 wherein the means for mounting the positioning means at a selected position around the rim of the basin comprises a housing containing the battery means and connected to the positioning means, the housing being portable to and away from the selected position around the rim of the basin with the battery mean contained within the housing.

9. The apparatus of claim 8 wherein the battery means is mounted in the portable housing, the portable housing being portable with batteries mounted therein.

10. The apparatus of claim 9 further comprising means for detecting the volume of water contained within the housing, the means for detecting including means for automatically interrupting the supply of power to the motor means when the volume of water contained within the housing is less than a selected minimum volume.

11. The apparatus of claim 1 wherein the motor means is connected to source of power for supplying power to the motor means, the means for automatically stopping automatically interrupting the supply of power to the motor means when the volume of water contained within the housing is less than a selected minimum volume.

12. The apparatus of claim 2 wherein the means for mounting the positioning means comprises a portable housing connected to the positioning means, the portable housing having means for receiving and containing a selected volume of water sufficient to immovably seat the housing by weight force on a surface above and around the rim of the basin at a selected position.

13. The apparatus of claim 3 wherein the means for mounting the positioning means comprises a portable housing connected to the positioning means, the portable housing having means for receiving and containing a selected volume of water sufficient to immovably seat the housing by weight force on a surface above and around the rim of the basin at a selected position.

14. The apparatus of claim 4 wherein the means for mounting the positioning means comprises a portable housing connected to the positioning means, the portable housing having means for receiving and containing a selected volume of water sufficient to immovably seat the housing by weight force on a surface above and around the rim of the basin at a selected position.

15. The apparatus of claim 7 wherein the positioning means includes means for selectively adjusting the position of the propeller at a selected depth below the upper level of water in the basin.

16. The apparatus of claim 15 wherein the protective housing includes means for reversible mounting and dismounting the housing from completely surrounding the propeller, the means for reversibly mounting being connected to a means for automatically stopping the propeller such that when the housing is dismounted from completely surrounding the propeller the propeller is automatically stopped.

17. The apparatus of claim 12 wherein the protective housing includes means for reversibly mounting and dismounting the housing from completely surrounding the propeller, the means for reversibly mounting being connected to a means for automatically stopping the propeller such that when the housing is dismounted from completely surrounding the propeller the propeller is automatically stopped.

18. The apparatus of claim 13 wherein the positioning means includes means for selectively adjusting the position of the propeller at a selected depth below the upper level of water in the basin.

19. The apparatus of claim 12 further comprising means for detecting the volume of water contained within the housing, the means for detecting including means for automatically stopping the motor means when the volume of water contained within the housing is less than a selected minimum volume.

20. The apparatus of claim 13 further comprising means for detecting the volume of water contained within the housing, the means for detecting including means for automatically stopping the motor means when the volume of water contained within the housing is less than a selected minimum volume.

* * * * *